US005367969A

United States Patent [19]

Nonaka

[11] Patent Number: 5,367,969

[45] Date of Patent: Nov. 29, 1994

[54] UPPER THREAD HOLDING DEVICE OF SEWING MACHINE

[75] Inventor: Shiro Nonaka, Kariya, Japan

[73] Assignee: Aisin Seiki Kabushiki Kaisha, Kariya, Japan

[21] Appl. No.: 115,355

[22] Filed: Sep. 2, 1993

Related U.S. Application Data

[63] Continuation of Ser. No. 888,625, May 27, 1992, abandoned.

[30] Foreign Application Priority Data

May 27, 1991 [JP] Japan ..... 3-121414

[51] Int. Cl.[5] ..... D05B 65/00

[52] U.S. Cl. ..... 112/295; 112/286; 112/300; 112/253

[58] Field of Search ..... 112/302, 285, 286, 287, 112/293, 295, 300, 301, 253, 294

[56] References Cited

U.S. PATENT DOCUMENTS

| | | | |
|---|---|---|---|
| 3,584,589 | 6/1971 | Pirrello | 112/295 |
| 3,998,172 | 12/1976 | Marforio | 112/293 |
| 4,450,781 | 5/1984 | Wickers et al. | 112/262.1 |
| 4,850,293 | 7/1989 | Norz et al. | 112/253 X |
| 4,913,073 | 4/1990 | Komori | 112/253 X |
| 4,962,714 | 10/1990 | Komori | 112/253 X |
| 5,007,358 | 4/1991 | Kawakubo et al. | 112/302 X |
| 5,020,462 | 6/1991 | Sato et al. | 112/302 |
| 5,025,738 | 6/1991 | Sato et al. | 112/235 X |
| 5,025,739 | 6/1991 | Inoue | 112/253 |
| 5,027,732 | 7/1991 | Sato et al. | 112/253 X |
| 5,080,031 | 1/1992 | Suzuki et al. | 112/286 |
| 5,127,350 | 7/1992 | Okada et al. | 112/295 X |
| 5,144,901 | 9/1992 | Suzuki | 112/253 |

FOREIGN PATENT DOCUMENTS

| | | | |
|---|---|---|---|
| 59-071773 | 4/1984 | Japan | 112/302 |
| 61-013997 | 1/1986 | Japan | 112/302 |
| 0214771 | 4/1990 | Japan . | |

*Primary Examiner*—Clifford D. Crowder
*Assistant Examiner*—Paul C. Lewis
*Attorney, Agent, or Firm*—Oblon, Spivak, McClelland, Maier & Neustadt

[57] ABSTRACT

An upper thread holding device for use in a sewing machine having a body and a needle from which an upper thread depends, the device includes a holding member pivoted to the body and movable between a waiting position and an upper thread holding position in such a manner that the holding member passes an upper thread taken-off position located between the needle and the waiting position, a driving device for moving the holding member, a stationary blade connected to the body so as to be in sliding engagement with a lower surface of the holding member and designed for cutting the upper thread in cooperation with the holding member in its return movement at the waiting position, and a press plate fixed to the stationary blade and defining a space therebetween in which the holding member is accommodated in its waiting position for holding between the press plate and the holding member.

7 Claims, 6 Drawing Sheets

UPPER THREAD HOLDING DEVICE OF SEWING MACHINE

This application is a continuation of application Ser. No. 07/888,625, filed on May 27, 1992, now abandoned.

BACKGROUND OF THE INVENTION

1. Field of the Invention

This invention relates to an upper thread holding device of a sewing machine having a thread cutting device.

2. Discussion of the Prior Art

An end of a thread sometimes becomes tangled, which constitutes a so-called nest on the back of a work piece such a cloth to be sewn when a sewing machine begins to sew the object. In order to avoid entanglement, a sewing machine including an upper thread holding device has been developed. In operation of this sewing machine, the upper thread holding device holds an upper thread which is cut in the last sewing operation, and the upper thread holding device releases or detaches therefrom the upper thread at the start of the next sewing operation. But the thread is cut only once at the end of the last sewing operation so that the length of the upper thread which extends from a hole of a needle is not even. Moreover, in case that the length of the upper thread which projects out from the workpiece is long, the tangled thread occurs at the back of the object and the finish is not good.

In order to shorten the length of the upper thread which is extended from the object, another sewing machine has been proposed in which the cutting of the upper thread is established at the start of the sewing operation as well as that at the end of the previous sewing operation. For instance, such a machine is disclosed in Japanese Utility Model Publication No. 2-14771 published in 1990 after examination. Referring to FIG. 8 showing the above mentioned machine, a needle-through groove 71 is formed at the center of a pressure foot 70 and a guide groove 72 is formed at the terminal end of the needle-through groove 71. A stationary blade 73 is fixed on the back of the pressure foot 70 and an edge 73*a* of the stationary blade 73 is disposed so as to traverse the guide groove 72. A thread holding member 74 catching an upper thread T is set above the pressure foot 70 so as to be able to be moved toward and from the upper thread T.

In operation of this machine, the thread holding member 74 advances and holds the upper thread T when a needle A is at its upper dead point. After catching the thread T the thread holding member 74 retracts. Sewing operation starts according to the above mentioned situation while another thread C between an object 75 to be sewn and the thread holding member 74 is being guided into the guide groove 71 of the pressure foot 70 as the object 75 is fed. At least the thread C is cut by the stationary blade 73 fixed to the pressure foot 70.

In the above mentioned construction, however, the distal end of the thread T is always cut while the thread T projects from upper surface of the object 75. It is not good for the quality of the sewed object that the distal end of the thread T projects therefrom.

SUMMARY OF THE INVENTION

It is an object of the invention to provide an improved upper thread holding device of a sewing machine which obviates the above conventional drawbacks.

It is another object of the invention to provide an improved upper thread holding device of a sewing machine which can finish sewing so that the end of the thread is not visible from the front side of the object.

It is further object of the to provide an improved upper thread holding device of a sewing machine which can finish sewing so that the tangled thread is not visible from the back side of the object.

In order to attain the foregoing objects, an upper thread holding device for use in a sewing machine having a body and a needle from which an upper thread depends, comprises a holding member pivoted to the body and movable between a waiting position and an upper thread holding position in such a manner that the holding member passes an upper thread taken off position located between the needle and the waiting position, driving means for moving the holding member, a stationary blade which is connected to the body so as to be in sliding engagement with a lower surface of the holding member and designed for cutting the upper thread in cooperation with the holding member in its return movement at the waiting position, and a press plate fixed to the stationary blade and defining a space therebetween in which the holding member is accommodated in its waiting position for holding between the press plate and the holding member.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DESCRIPTION OF THE PREFERRED EMBODIMENTS

Figure 1:
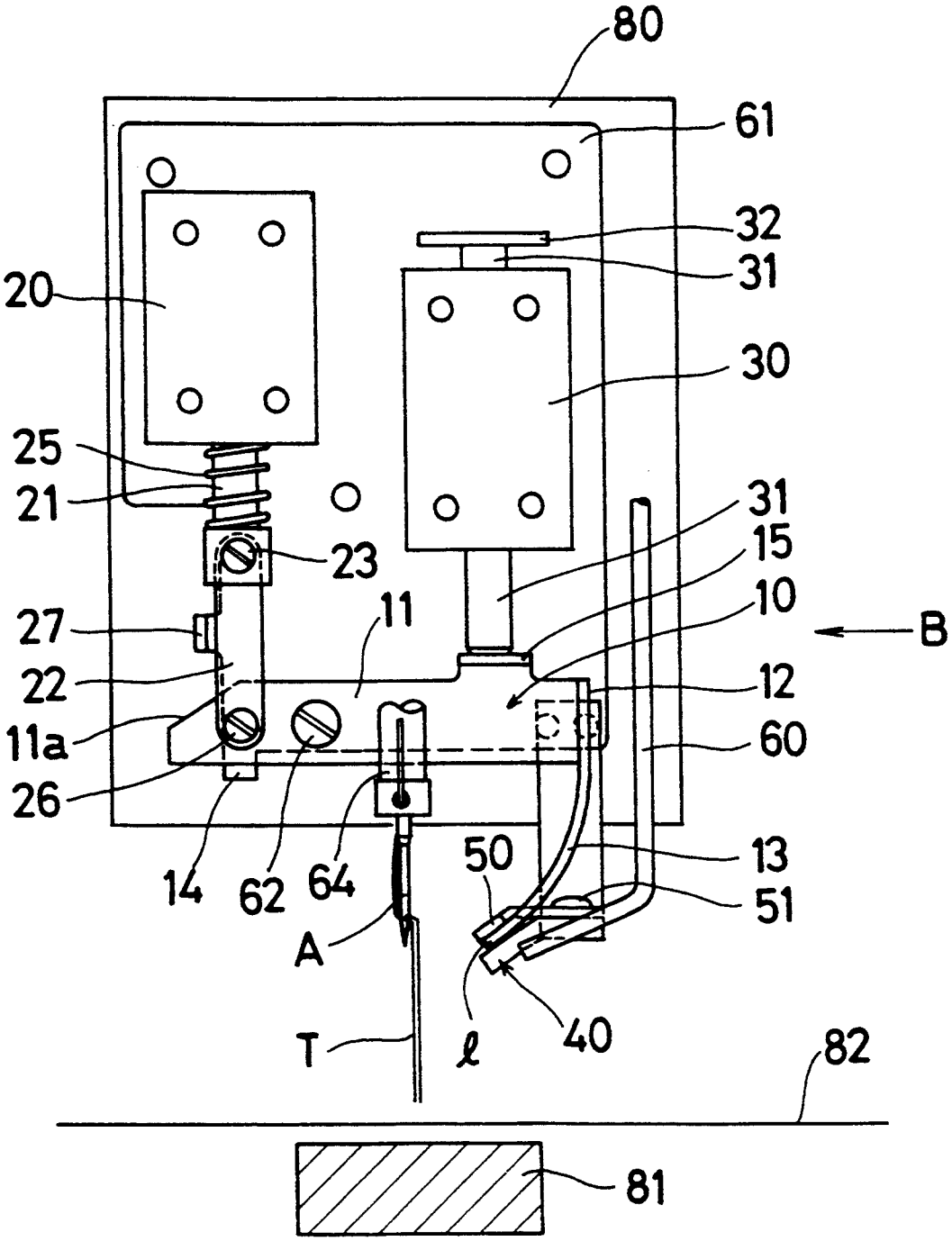
FIG. 1 is a front view of an upper thread holding device of a sewing machine at a waiting position according to the present invention.

Referring to FIG. 1, there is illustrated an upper thread holding device of a sewing machine which mainly includes a holding member 10 which catches an upper thread T, a first solenoid 20 and a second solenoid 30, both of which operate as driving means, a stationary blade 40 fixed to the plate 61 and a press plate 50 installed to the stationary blade 40.

Figure 5:
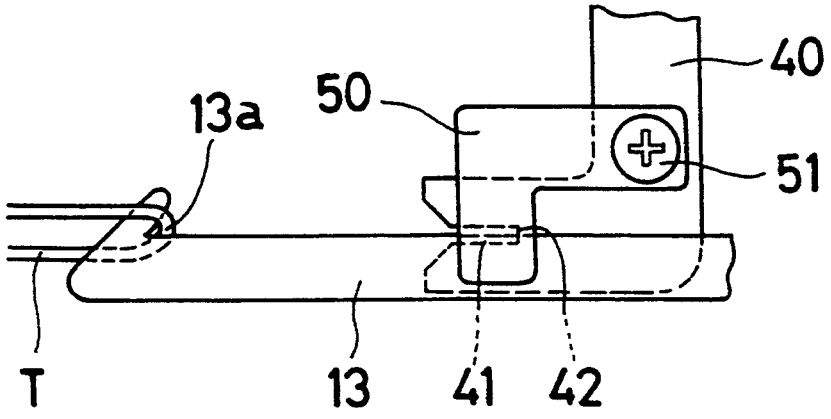
FIG. 5 is a plan view showing the holding member catching the upper thread according to this invention.

The plate 61 is fixed to a machine body 80 and the holding member 10 is pivoted to the plate 61 by a screw 62 acting as a fulcrum axis. The screw 62 has, as its lower, middle and upper portions, a screw portion screwed into the plate 61, a cylinder portion for mounting the holding member 10 rotatably and the flange portion, respectively. The holding member 10 includes a horizontal part 11 pivoted to the plate 61, an inclined plane 11*a* formed on an upper left end of the horizontal part 11, a vertical part 12 formed at the right end of the horizontal part 11 so as to be perpendicular thereto in FIG. 1, and a holding part 13 which extends downward from the vertical part 12 while being bent. The horizontal part 11 has a push receiving part 15 which extends from the upper end of the horizontal part 11. The counterclockwise rotational motion of the horizontal part 11 is restricted by a stopper 14 formed at a lower end of the plate 61 so as to be located below the horizontal part 11 and the clockwise rotational motion is restricted by a stopper 27 formed at a left side end of the plate 61. The holding part 13 is terminated in a hook 13*a* as best shown in FIG. 5 in order to hold the upper thread T easily. Thus, on operation of the first solenoid 20 which is described herein after, the holding member 10 moves, by rotating about the screw 62 from waiting position shown in FIG. 1 to the holding position shown in FIG. 2 at which the upper thread is caught by holding member 10.

Figure 7:
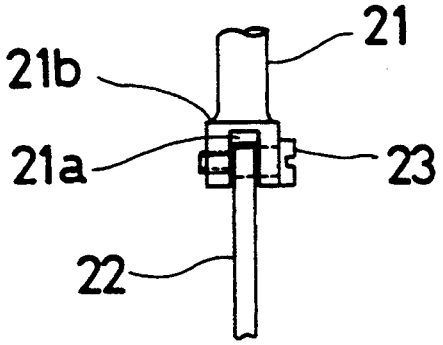
FIG. 7 is a part view showing a connection between a rod and a driving member according to this invention.
Figure 8:
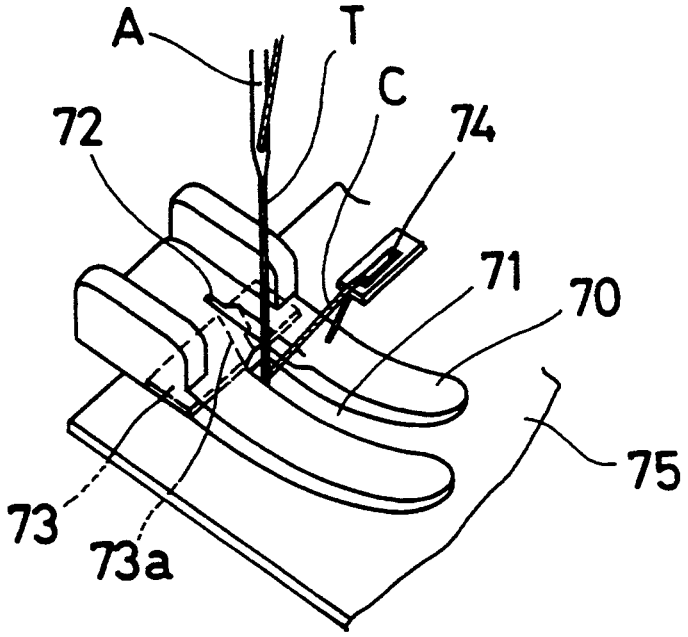
Fig. 8 PRIOR ART
FIG. 8 is a perspective view of an upper thread holding device of a sewing machine according to the prior art.

The driving means includes the first solenoid 20 and the second solenoid 30. The first solenoid 20 is fixed on the left side of the wall of the plate 61 (FIG. 1). A driving member 21 which is driven by the first solenoid 20 extends from the lower end of the first solenoid 20. As best shown in FIG. 7, a stopper portion 21*b* which expands in the downward direction and terminates in a groove 21*a* is formed in the stopper portion 21*b*. One end of a rod 22 is inserted into the groove 21*a* and pivoted to the stopper portion 21*b* by a screw 23 which is similar to the screw 62 in structure and function. A spring 25 is set around the driving member 21 and a lower end portion of the spring 25 is held by the stopper portion 21*b*. The other end portion of the rod 22 is pivoted to the horizontal part 11 by a screw 26 which is similar to the screw 62 in structure and function, and which is spaced from the screw 62 by a first distance.

The second solenoid 30 is fixed on the plate 61 at a right side of the first solenoid 20 as shown in FIG. 1. A driving member 31 is set to be moved in the vertical direction by the second solenoid 20. A stopper 32 is formed integrally with an upper end of the driving member 31 above the second solenoid 30 and is set to restrict the downward motion of the driving member 31. The lower surface of the driving member 31 is set to push the receiving part 15 of the horizontal part 11, which is spaced from the screw 62 by a second distance which is greater than the first distance, upon downward motion of the driving member 31. The first solenoid 20 and the second solenoid 30 are connected to a controller (not shown) and controlled thereby.

The stationary blade 40 is fixed at one end portion thereof to the lower portion of the plate 61. The stationary blade 40 is extended in the downward direction and terminates in an angled portion whose plane is perpendicular to the axis of the driving member 31. The angled portion extends toward the needle shaft 64. Referring to FIG. 5, a groove 41 is formed in the distal end of the stationary blade 40 which opens toward the needle shaft 40 and a blade part 42 is formed at the closed terminal end of the groove 41. In order that the upper thread T caught by the hook 13*a* may go through the groove 41, the groove 41 and the hook 13*a* of the holding part 13 are located on a common straight line.

The press plate 50 is fixed on the stationary blade 40 by a screw 51 and formed like a letter L as shown in FIG. 5. The other portion of the press 50 is set above the groove 41. The space l is made between the press plate 50 and the stationary blade 40 and the holding part 13 slides in the space l.

An air pipe 60 is installed near the stationary blade 40 and the holding member 10. The distal end of the air pipe 60 opens toward the blade part 42 for absorbing waste resulting from a thread cutting operation of the stationary blade 40.

Figure 2:
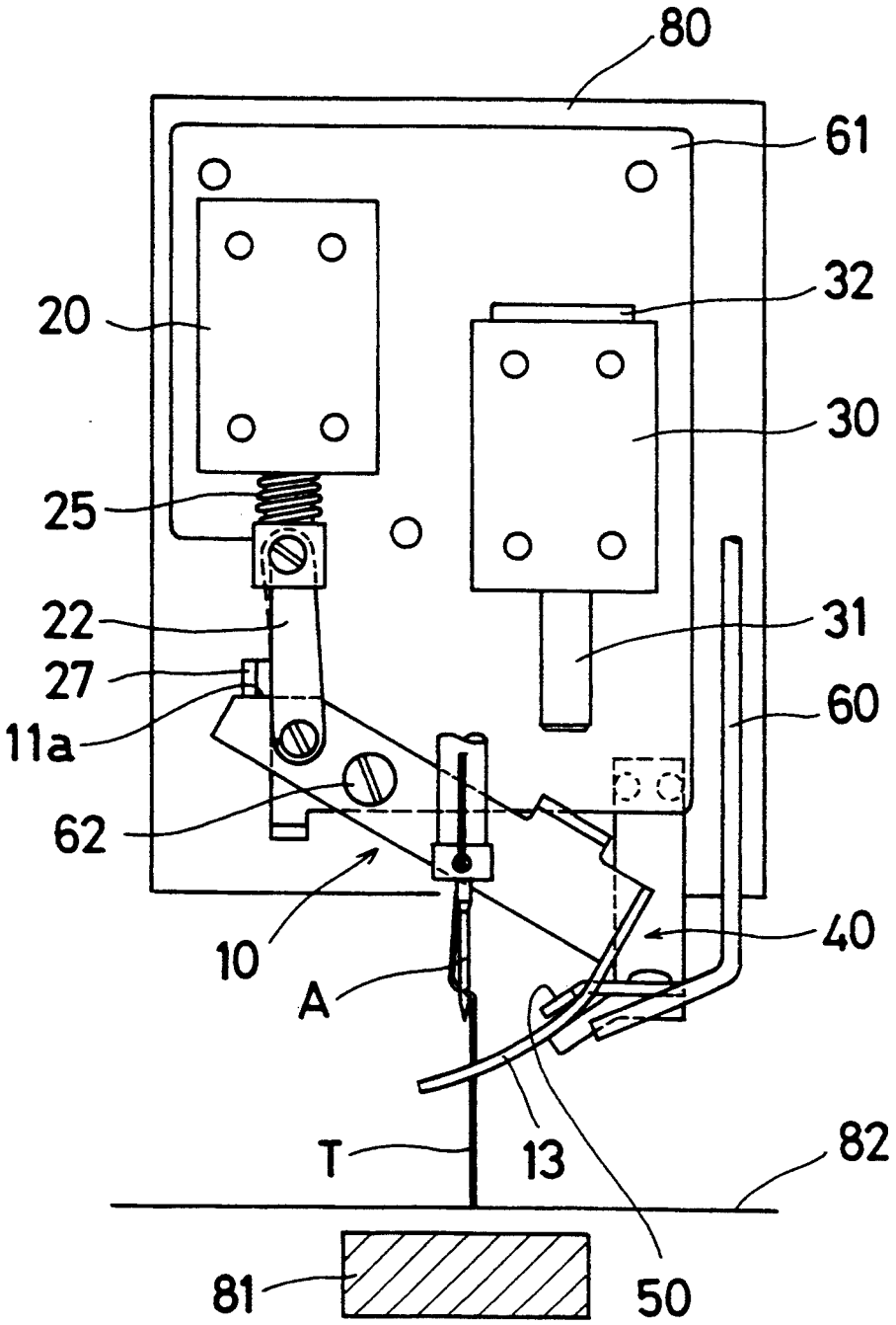
FIG. 2 is a front view of an upper thread holding device of a sewing machine at an upper thread holding position according to the present invention, in which a holding member is catching an upper thread.
Figure 3:
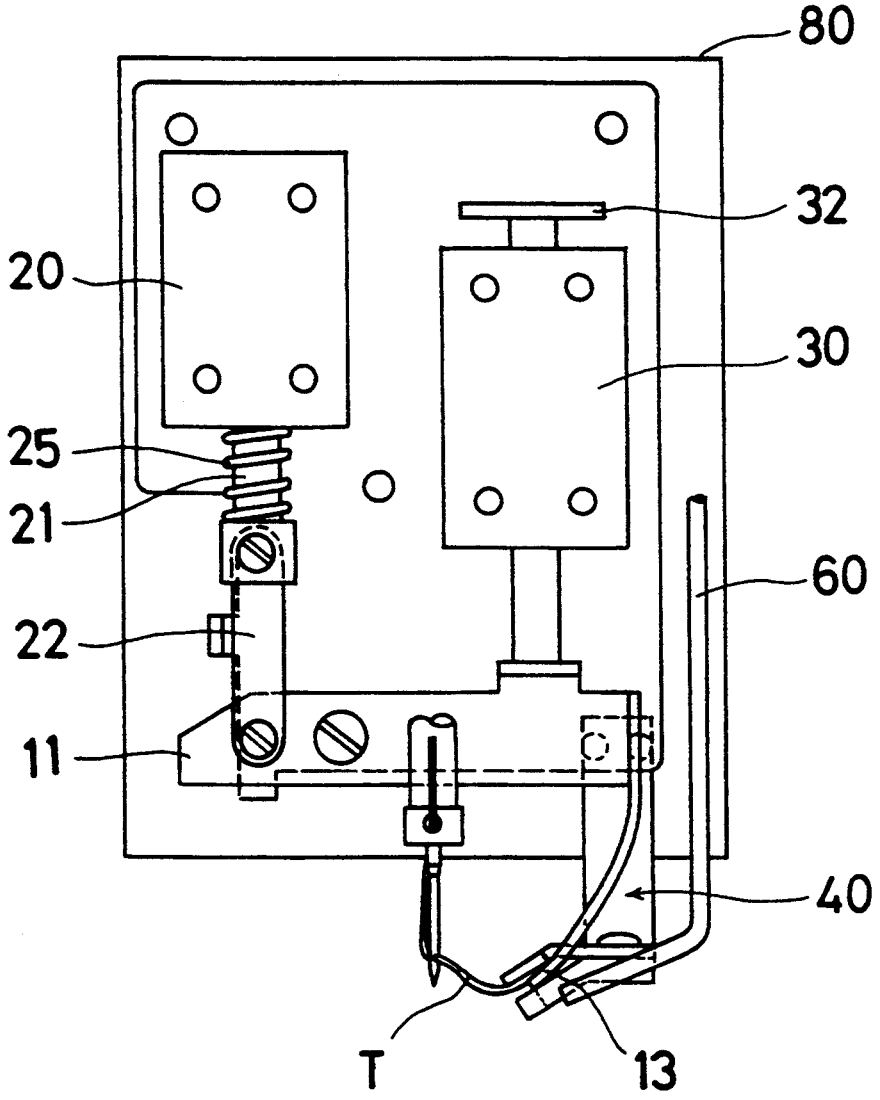
FIG. 3 is a front view of an upper thread holding device of a sewing machine at a waiting position according to the present invention, in which the upper thread has just been cut by a stationary blade.
Figure 4:
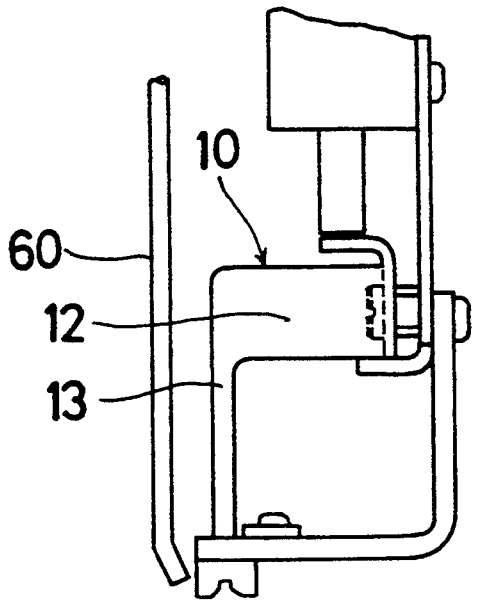
FIG. 4 is a view seen from a direction of B in FIG. 1.
Figure 6:
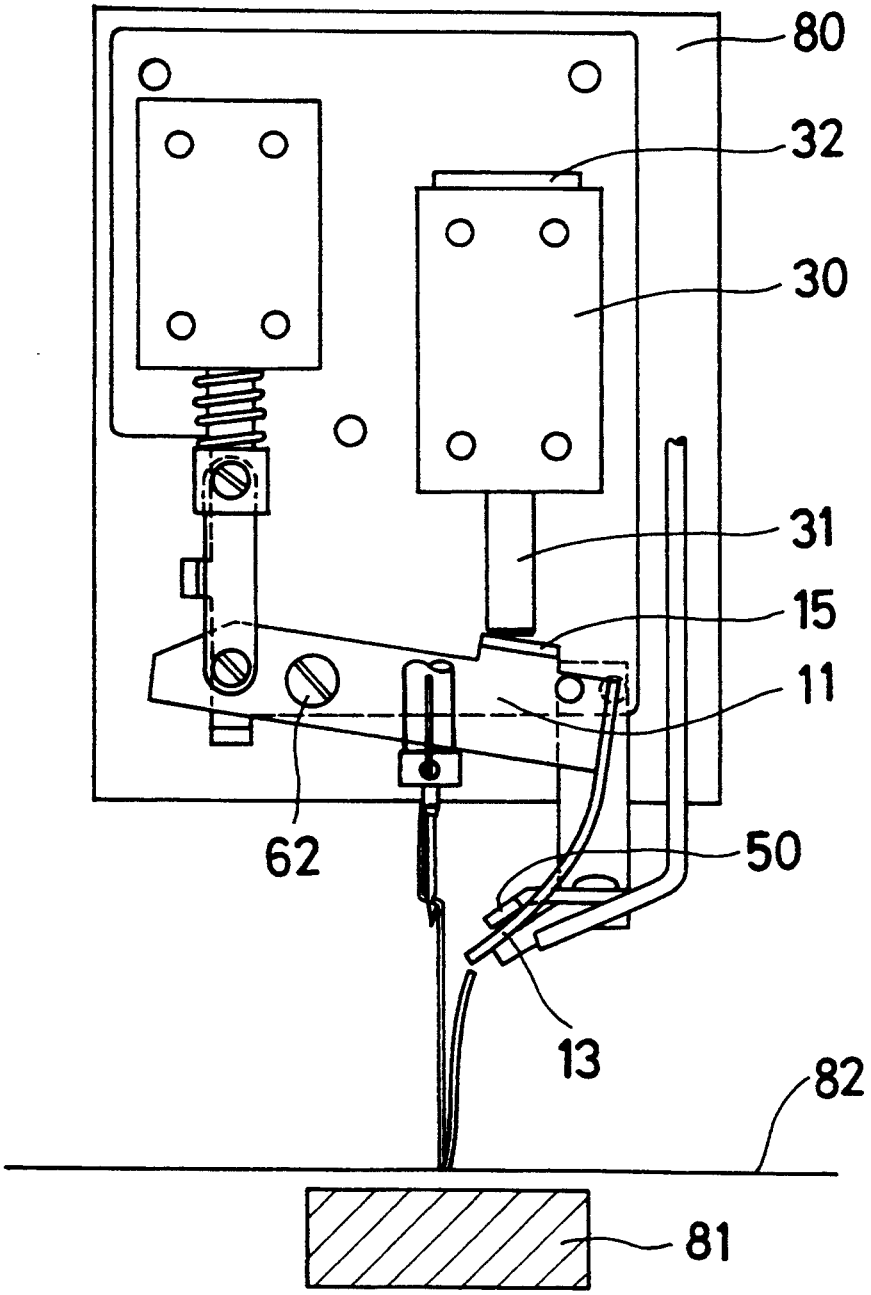
FIG. 6 is a front view showing an upper thread holding device of a sewing machine in which the upper thread has just been taken off from the holding member at an upper thread taken off position according to the present invention.

When the upper thread holding device of this invention does not operate, referring to FIG. 1, the holding member 10 is positioned at its waiting position where the lower surface of the horizontal part 11 is in abutment with the stopper 14 and the distal end of the holding part 13 is positioned between the stationary blade 40 and the press plate 50. If the upper thread is cut by an automatic thread cutting device 81 installed under a base plate after a sewing operation, the first solenoid 20 operates immediately to raise the rod 22 (FIG. 2) and the left end of the horizontal part 11 of the holding member 10. Thus the holding member 10 rotates about the screw 62 in the clockwise direction and the holding part 13 is moved from the waiting position to the holding position where the holding part 13 is positioned under a needle A. The rotation angle of the holding member 10 is limited by the engagement of the inclined plane 11*a* of the horizontal part 11 with the stopper 27. After this, energization of the first solenoid 20 is stopped and the rod 22 is returned to its home position by the expansion force of the spring 25. During this time, the driving member 31 of the second solenoid 30 separates from the holding member, as shown in FIG. 2. With the above mentioned operation, the holding part 13 goes back to the waiting position from the holding position. At this time, the hook of the holding part 13 catches the upper thread T (FIG. 5) and just when the holding member is returned to the waiting position, the upper thread T is pushed on to the blade part 42 after being guided in the groove 41 and cut at a length from the needle A (FIG. 6). Referring to FIG. 3, the upper thread T after being cut is caught between the holding part 13 and the press plate 50, and the waste thread is absorbed by the air pipe 60 which has a negative pressure.

Then a new or next sewing operation starts. The needle A goes down and the upper thread T turns around a shuttle (not shown). The second solenoid 30 is activated immediately before the upper thread T is drawn from the shuttle and the driving member 31 goes down until the stopper 32 fits or abuts on the upper surface of the second solenoid 30. The driving member 31 pushes the press part 15 of the horizontal part 11, which rotates the holding member 10 in the clockwise direction about the screw 62. Thus the holding member 10 is projected to an upper thread taken-off position where the upper thread T is taken off from the space between the press plate 50 and the holding part 13. The upper thread taken-off position is located between the waiting position and the place under the needle A, nearer the waiting position than the holding position.

As mentioned above, according to the present invention, the length of the upper thread, which is defined as a distance between the hole of the needle A and the end of the upper thread T, is constant because the upper thread is cut by the stationary blade 40 and the length of the end of the upper thread which projects from the lower surface of the clothes is short and stable. Moreover the upper thread T is set to be held between the holding part 13 and the press plate 50 at the start of sewing and is taken off in the above mentioned timing manner so that the upper thread T is not taken off from the hole of the needle A. The end of the upper thread T is pulled under the clothes by the rotation of the shuttle and does not appear above the surface of the cloth. Thus it is possible to established a nice finished sewed cloth.

In this embodiment, the upper thread T is taken off by the operation of the second solenoid 30 immediately before the upper thread T is left from the shuttle. The timing when the upper thread T is taken off can be adjusted by the rotation of a button and so on, easily. Instead of the first solenoid 20 and the second solenoid 30, a sole linear solenoid having more than two operation modes can be used. An employment of such solenoid enables the miniaturization of the device.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An upper thread holding device for use in a sewing machine having a body and a needle from which an upper thread depends, said device comprising:

an elongate holding member pivotally mounted to said body about a fixed fulcrum axis for movement between a waiting position and an upper thread holding position in such a manner that said holding member passes an upper thread taken-off position located between said needle and said waiting position;

driving means for moving said holding member;

a stationary blade connected to said body so as to be in sliding engagement with a lower surface of aid holding member, for cutting said upper thread in cooperation with said holding member during return movement of the holding member to said waiting position; and a press plate fixed to said stationary blade and defining a space therebetween in which a portion of said holding member is accommodated when the holding member is in the waiting position for holding the upper thread between said press plate and said holding member, wherein said driving means comprises a first solenoid and a second solenoid, said solenoids acting on longitudinally opposite ends of said holding member to pivot said holding member about said axis, both of said solenoids acting on said holding member so as to pivot said holding member with the same rotational sense, wherein said first solenoid is pivotally connected to said holding member at a first distance from said fulcrum axis, and wherein said second solenoid is positioned to press on said holding member at a second distance from said fulcrum axis, said second distance being greater than said first distance, said second solenoid being separable from said holding member in response to pivoting of said holding member by said first solenoid.

2. An upper thread holding device of a sewing machine according to claim 1, in which said first solenoid moves said holding member from said waiting position to said holding position and said second solenoid moves said holding member from said waiting position to said upper thread taken-off position.

3. An upper thread holding device of a sewing machine according to claim 1, in which said stationary blade comprises a groove which is formed on a top of said stationary blade to open in said direction to where said holding member moves; and a blade part which is formed on said terminal end of said groove.

4. An upper thread holding device of a sewing machine according to claim 1, in which said first solenoid and said second solenoid act on ends of said holding member which are on opposite sides relative to said axis.

5. An upper thread holding device according to claim 1 wherein said fixed fulcrum axis extends substantially transverse to a direction of movement of said portion of said holding member.

6. An upper thread holding device according to claim 1 including a stationary stopper abutted by said holding member when said holding member is at said thread holding position.

7. An upper thread holding device according to claim 1 including a spring biasing said holding member away from said thread holding position.

* * * * *